US007033102B2

(12) United States Patent
Bhavnani

(10) Patent No.: US 7,033,102 B2
(45) **Date of Patent: *Apr. 25, 2006**

(54) CALCULATING PEN

(75) Inventor: Dilip Bhavnani, Beverly Hills, CA (US)

(73) Assignee: SunCoast Merchandise Corporation, Commerce, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/051,203

(22) Filed: Feb. 3, 2005

(65) Prior Publication Data

US 2006/0051156 A1 Mar. 9, 2006

Related U.S. Application Data

(63) Continuation of application No. 10/916,652, filed on Aug. 11, 2004, now Pat. No. 6,890,117.

(60) Provisional application No. 60/510,561, filed on Oct. 10, 2003.

(51) Int. Cl.
*B43K 29/00* (2006.01)

(52) U.S. Cl. ..... 401/195; 401/52; 235/87 A; 235/87 R

(58) Field of Classification Search ..... 401/52, 401/195; 235/64, 79.5, 87 A, 87 R
See application file for complete search history.

(56) References Cited

U.S. PATENT DOCUMENTS

| | | | | |
|---|---|---|---|---|
| 2,646,220 | A * | 7/1953 | Weiser | 401/195 |
| 2,777,636 | A * | 1/1957 | Weiser | 401/195 |
| 4,007,364 | A | 2/1977 | Ojima | |
| 4,984,494 | A | 1/1991 | Yang | |
| 5,028,764 | A | 7/1991 | Kuhlengel | |
| 6,104,603 | A | 8/2000 | Wang | |
| 6,890,117 | B1 | 5/2005 | Hazzard | |

* cited by examiner

*Primary Examiner*—Tuan Nguyen
(74) *Attorney, Agent, or Firm*—The Soni Law Firm

(57) ABSTRACT

The present invention generally relates to a writing instrument that includes a means for calculating the result of specific a non-linear equation, such as the Body Mass Index (BMI) of a person or the energy developed by a falling object. The present invention is a writing instrument which combines a writing instrument with a calculating device in one lightweight and commonly used type of device, thereby freeing the user of the need to refer to complicated charts or other technical materials. The writing implement has a first end which includes the writing tip portion and a second end which includes the tables and operational elements used to calculate a particular formula based on user specified numerical values.

9 Claims, 3 Drawing Sheets

BMI TABLE ACCORDING TO PRESENT INVENTION

CALCULATING PEN

CROSS-REFERENCE TO RELATED APPLICATIONS

This application claims priority to and is a continuation of U.S. application Ser. No. 10/916,652, filed Aug. 11, 2004 which was originally filed as a provisional application on filed on Oct. 10, 2003 (Ser. No. 60/510,561), and is now issued as U.S. Pat. No. 6,890,117. Both applications were owned by the Assignee, Sun Coast Merchandise Corp, at the time of the present inventions.

BACKGROUND OF THE INVENTION

The present invention generally relates to a writing instrument that includes a means for calculating a non-linear equation of any type. For example, one use of the invention would be to calculate a person's body mass index (BMI), which may be determined based on the following equation: $M/L^2$, where M is the body weight in kilograms, and L is the body height in meters. It is recognized that other equations may be used for calculating the BMI. For instance, the body weight may be expressed in pounds, and the body height by inches. Nonetheless, the present invention may be used as a calculating device to calculate the resultant number from a predetermined non-linear equation.

Numerous pens and other devices are available to determine the resultant figure from a simple linear equation, such as an ordinary mathematical multiplication table. In order to calculate a non-linear function, however, a logarithmic type of scale must be introduces, as well as a means for accessing the appropriate numerical values on both the logarithmic scale and the remaining factor(s) of the equation.

Each such implement would typically be capable of calculating a limited scope of non-linear functions. For example, the BMI calculating implement discussed above would be a device which would typically be dedicated to performing only that calculation. The limiting factor for the scope of calculation functions possible would generally be the space limitation on the barrel of the device, as that surface area would include the printed values for at least one of the resultant tables. The incorporation of different colors for different calculations, however, as an example, could permit a single device to perform multiple independent non-linear calculations. To ability to utilize a writing implement as a device to perform quick and accurate calculations would benefit the user by reducing their dependence upon number of separate products including, for example, various medical instruments, tables, books and charts, pieces of diagnostic equipment, stethoscopes, height/weight scales, writing pens, patient charts, prescription pads, and the like. Although conventional electronic devices may be effective in calculating non-linear equations, the user must handle and operate these devices separately in addition to various other items. Many health-care providers, technicians, mechanics and other users would like to reduce the number of items that they must handle during the performance of their duties.

U.S. Pat. No. 5,028,764 to Kuhlengel discloses a pen with rotatable cylindrical elements that are used to perform a simple calculation in the multiplication of two numbers. U.S. Pat. No. 6,104,603 to Wang discloses a writing pen with an integral electronic calculator including printed circuit board, keyboard and power supply. In each of these patents, the invention provides its user no capability to perform a specific non-linear calculation, as the former will not permit a non-linear calculation and the latter relies upon the user to supply a formula, in addition to its dependence on electronic, rather than manual components. Therefore, neither patent involves a device which may be manually employed to quickly determine the numerical outcome of a specific non-linear relationship equation, such as the Body Mass Index of a person, based jointly on multiple variables, in this case the two factors being their height and weight.

SUMMARY OF THE INVENTION

The present invention addresses and overcomes the need for the an individual to have at hand the above described diagnostic equipment or manuals by providing a writing instrument that combines a writing implement with a manual calculator for determining the result of a non-linear equation. Health-care providers can use the proposed writing instrument to determine the BMI of a patient, and as a writing pen for recording information in patient charts, submitting prescriptions, and the like. Similarly, an engineer or a mechanic can operate the device to calculate many of the required calculations of their occupation, such as beam stresses, horsepower, speed and acceleration relationships and the like. The present invention combines a writing instrument with a calculating device in one lightweight and commonly used type of device, thereby freeing the user of the need to refer to complicated charts or other technical materials. These and other objects, features, and advantages of the invention are evident from the following description and attached drawings.

In one preferred embodiment of the invention, the writing implement has a first end which includes the writing tip portion and a second end which includes the tables and operational elements, such as would be used to calculate an individual's BMI.

Referring to FIGS. 1 and 2 attached hereto, the writing instrument of the present invention includes an elongated, cylindrical housing that is tapered at a first end. The tapered end includes an opening for the writing point such as a retractable pen insert located within the housing. The instrument may also include a rubber grip handle surrounding and disposed radially outwardly about the first end so that a user can grip the instrument and write with it more easily, as shown in FIGS. 3 and 4. The second end of the instrument may include a clip for attaching it to a clothing pocket or other object. The second end may further include a click or push button that may be pushed to advance and retract the pen insert as needed.

The writing instrument includes a scale printed on its outer surface. The scale extends longitudinally along a surface portion of the instrument and contains a sliding marker that is moved to a position on the scale indicating the desired value for this particular variable in the equation. The sliding marker also identifies the calculation result as further discussed below. In the BMI calculation embodiment shown in FIGS. 1 and 2, the height scale uses inches to record the patient's height. However, it is recognized that a metric scale could be used in alternative embodiments. The instrument further includes an elongated, transparent window that extends in parallel to the height scale.

In addition, the writing instrument includes a rotatable dial having a related scale printed on its surface. The dial may include two rotatable segments. For example in the BMI embodiment, one dial segment may be printed with indicia representing a weight range of 90 to 210 pounds. The other dial segment may be printed with indicia representing a weight range of 215 to 330 pounds. The different weight scales may be of the same color or different colors. For example, in one embodiment, the weight scale of 90 to 210 pounds is colored blue, while the weight scale of 215 to 330 pounds is colored red. The dial is connected to a rotatable cylinder located within the instrument's elongated housing. The rotatable cylinder includes the resultant values, in this embodiment, a BMI scale, printed on its surface.

In practice with the preferred embodiment of a BMI calculating implement, the user first inputs the weight of the patient by rotating the dial on the weight scale to a set point in indicating the patient's actual weight. (The weight indicator is similar to the Y axis on a graph.) Then, the user inputs the height of the patient by moving the sliding marker along the height scale to a set point indicating the patient's actual height. (The height indicator is similar to the X axis on a graph.) The rotatable cylinder that is located within the housing of the instrument rotates along with the rotation of the dial, thereby displaying the BMI based on the weight and height input settings. The BMI reading is visible on the cylinder through the elongated, transparent window. The rotatable cylinder that records the BMI can be colored, so that the BMI reading is immediately noticeable. For example, in one embodiment, the rotatable cylinder is colored yellow. As the rotatable cylinder would necessarily be limited in size, it may become necessary to include tow or more rotatable segments to increase the weight range for which its use may be suitable. For example, one dial segment may be printed with indicia representing a weight range of 90 to 210 pounds. The other dial segment may be printed with indicia representing a weight range of 215 to 330 pounds. In this example, two colors would be used for the BMI values printed on the rotatable cylinder such that the appropriate BMI value would be readily discernable to the user based upon the color of BMI values corresponding to the rotation of either the first or second rotatable segment according to the patient's weight.

As discussed above, the BMI of a person has many useful applications in medical and other fields. For instance, the BMI can be used to prescribe the proper amount of medicine for a patient. A health-care provider can use the unique writing instrument of this invention for calculating the BMI of a patient, and as a writing pen.

Although the discussed preferred embodiment is that of a BMI calculation, the various scales could represent time, distance, speed, or any number of variables to enable the implement to be used in a similar fashion to perform a different non-linear calculation. For example, an automotive engineer could utilize the invention to calculate an acceleration rate or an energy consumption calculation, based on speed, time, distance and other variables. In yet another embodiment, a stylus point tip would be included near the orifice from which the writing tip would project. This point would then be available for the user to operate a PDA or other type of input device.

DETAILED DESCRIPTION OF THE INVENTION

Figure 1:
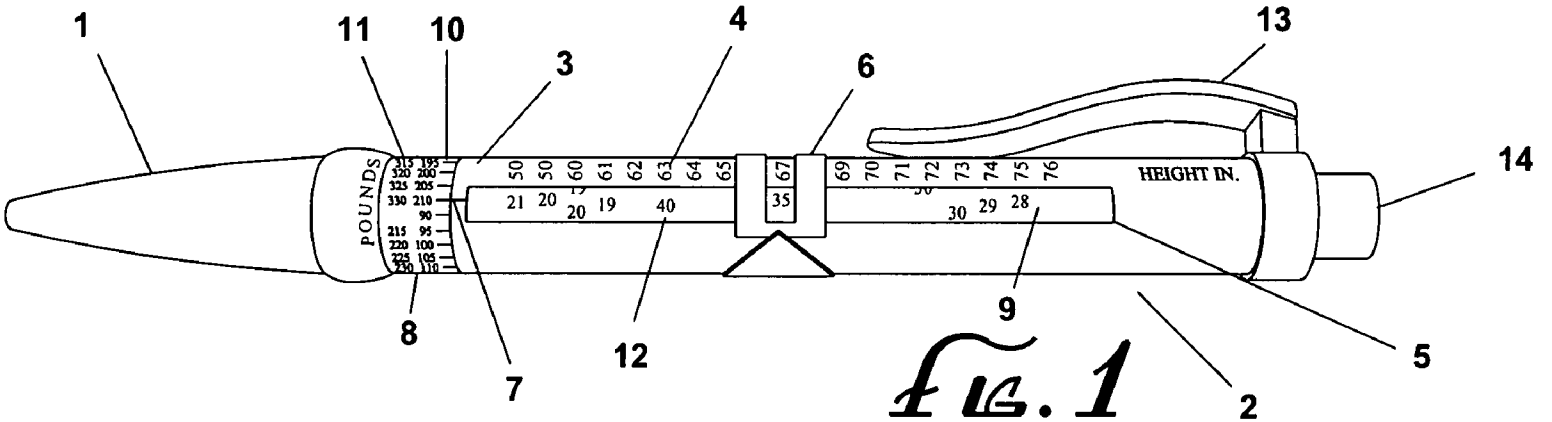
FIG. 1 is a view of one embodiment of the writing instrument of the present invention used to calculate an individual's BMI, including the height scale along the length of the second end of the pen and the transparent window through which the user may read the BMI at the sliding marker position.
Figure 2:
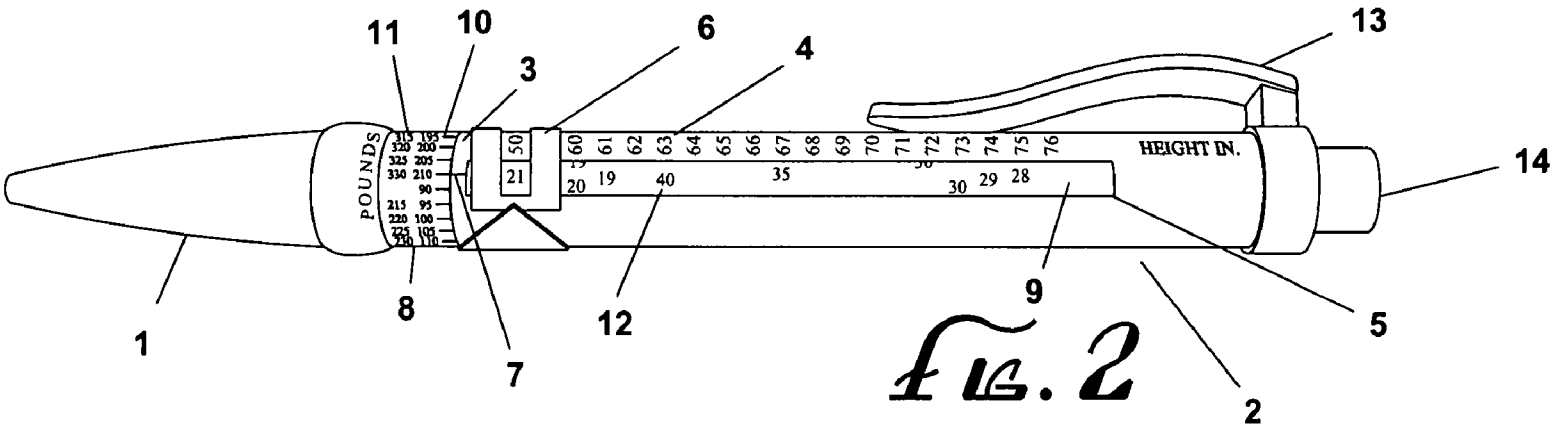
FIG. 2 is second view of writing instrument of the present invention used to calculate an individual's BMI, as in FIG. 1, showing the various components of the instrument, including the rotating dial for weight selection, the BMI sliding marker indicator window at a lower position and the cylinder on which the red and blue BMI values are printed.

The present invention relates to a writing instrument which includes a means by which its user may quickly determine the result of a non-linear equation through rotation of a dial and sliding of a window. As shown in FIGS. 1 through 4, the preferred embodiment of the present invention relates to a device used to calculate the Body Mass Index (BMI) of an individual of known height and weight. In a preferred embodiment, the writing instrument as shown in FIGS. 1 and 2 comprises a first end (1) and a second end (2). The first end, through which a writing tip may extend and/or retract is attached to the second end such that said writing instrument is a unitized assembly.

In the preferred embodiment, the second end comprises am outer surface (3), on which a body height scale (4) is printed, to correspond with the height component of the BMI calculation. Said outer surface further includes an elongated transparent window (5) that extends in parallel to the height scale. A sliding marker (6) is retained by the height scale (4) and transparent window (5), such that said sliding marker may be manually slid lengthwise along the transparent window (5) to a position to correspond with the individual's actual body height. The outer surface (3) includes a designation (7), such as a short axial line mark, at the midpoint of the distal end of the elongated transparent window (5).

A rotatable dial (8) having a body weight scale printed on its surface is affixed to the second end (2) such that it is connected to a rotatable cylinder (9) located within the instrument's elongated housing within the second end. The body weight scale designations of the rotatable dial (8) are segmented with incremental axial marks (10) printed on the circumference of the dial. The dial (8) has at least one rotatable segment (11) and may have two or more rotatable segments to increase the weight range for which its use may be suitable. For example, one dial segment may be printed with indicia representing a weight range of 90 to 210 pounds. The other dial segment may be printed with indicia representing a weight range of 215 to 330 pounds. The different weight scales may be of the same color or different colors. The attached rotatable cylinder (9) includes a BMI scale printed on its surface (12), which is partially visible through the transparent elongated window (5) and through the sliding marker (6).

To quickly calculate determine the individual's BMI, the user of the invention moves the sliding marker (6) to a position wherein the height scale (4) number corresponding to the individual's actual height is centered in the transparent rectangle of the sliding marker (6). The user then turns the rotatable dial (8) to a position wherein the printed body weight scale number and axial mark (10) most closely corresponding to the individual's actual weight is aligned with the designation (7) to center the desired weight scale numerical value in the elongated transparent window (5).

Figure 5:
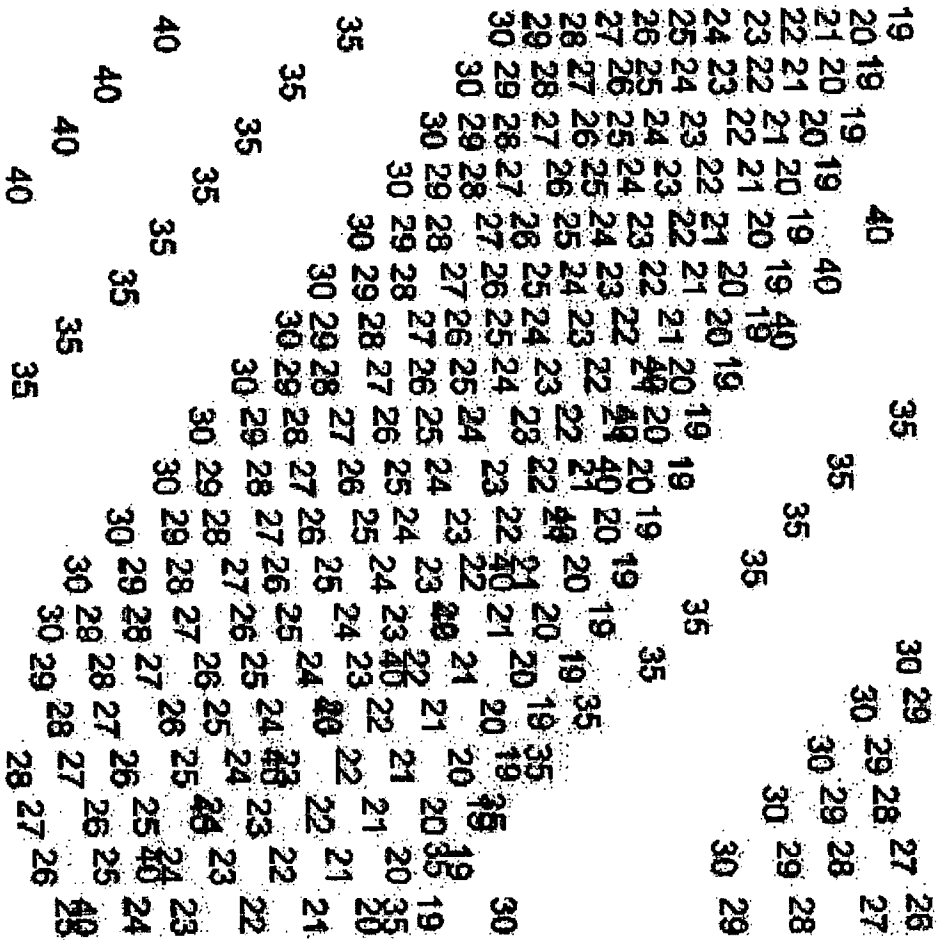

Having set the sliding marker (6) to correspond with the individual's height and the rotatable dial to correspond to the individual's weight, the user would look through the sliding marker at the elongated transparent window (5) and the number printed on the rotatable cylinder (9) visible through the rectangular window of the sliding marker (6) would be the individual's BMI. FIG. 5 depicts a logarithmic scale such as would be imprinted on the rotating cylinder of the preferred embodiment.

In other embodiments, the writing instrument may be a pencil, highlighter or other printing device other than a pen. The writing instrument may include a clip (13) for attachment to the user's pocket or other point of attachment, with the clip having a surface area appropriate for imprinting of advertising or other graphics. The printing of advertisement in this area, as well in the unused portions of the outer surface of the implement, greatly enhance the practical purposes of this pen as innumerable vendors and suppliers would be desirous of utilizing these devices as an advertising vehicle to the automotive medical and pharmaceutical industries, among others. The writing instrument may further include a click or push button (14) that may be pushed to advance and retract the pen insert as needed.

Figure 3:
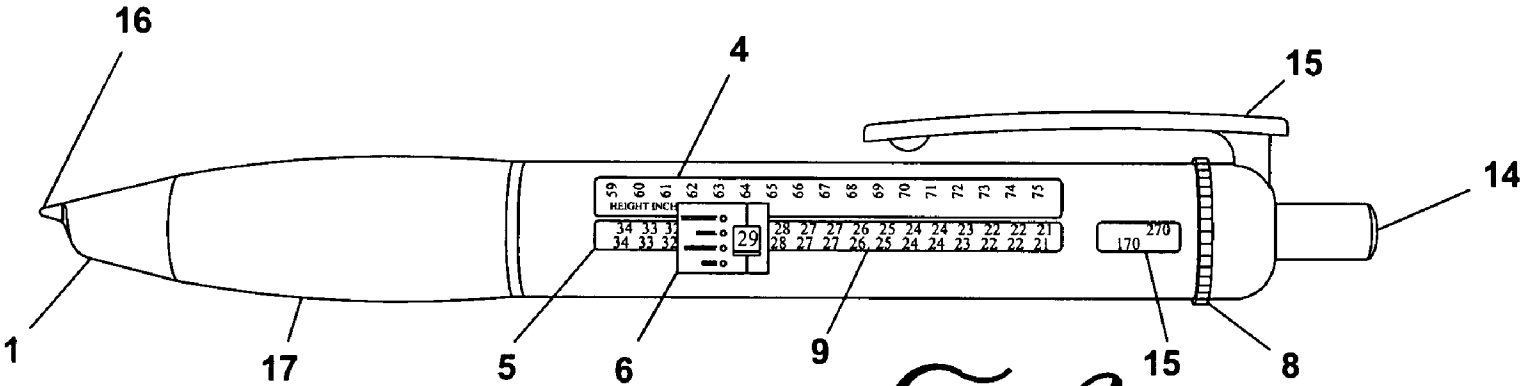
FIG. 3 is a view of a second embodiment whereby the rotating dial assembly is relocated to the clip end of the implement, a rubber or cushioned grip is included proximate the writing tip end of the device and a stylus point is also included at the writing tip end of the implement. In this drawing, the writing tip is retracted and not seen.
Figure 4:
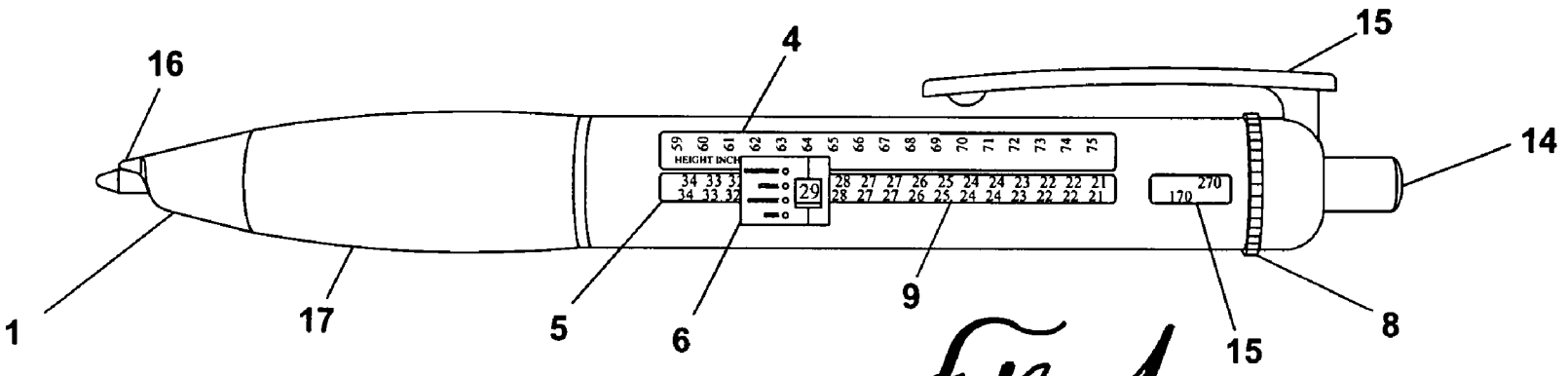
FIG. 4 is a view of the second embodiment as shown in FIG. 3, however, the writing tip is extended and therefore is visible in FIG. 4.

The various components of the implement need not be positioned in the exact manner as described above and shown in FIGS. 1 and 2. For example, FIGS. 3 and 4 depict a second embodiment whereby the rotatable dial (8) is located at the clip end of the pen. In this configuration, a second small window (15) is incorporated to display the individual's weight. The sliding marker (6) is again slid to the corresponding value on the height scale (4) and the resultant individual BMI is read through the transparent rectangle of the sliding marker (6). In this second embodiment a stylus tip (16) is incorporated at the end of the implement from which the writing tip would extend and retract. In addition, a rubber or cushion grip (17) is added to the lower barrel of the implement to increase the user's comfort when using the implement. It is appreciated by those skilled in the art that various changes and modifications can be made to the illustrated embodiments and description herein without departing from the spirit of the present invention.

I claim:

1. A writing instrument for performing at least one non-linear calculation comprising:

an elongated housing having a first end and a second end;

said first end including a means for writing comprising of an ink or other writing tip, with said writing tip extending through an axial orifice in the first end;

said second end having an outer surface rotatably engaged to a rotatable dial having a first numerical values scale with designations printed so as to be visible at the circumference of the writing instrument;

said second end further including a second numerical values scale printed longitudinally along its outer surface and an elongated transparent window that extends longitudinally along said outer surface in parallel to said second scale;

said rotatable dial rigidly affixed to a rotatable cylinder disposed radially inward of the housing within said second end and having resultant calculation values of a desired non-linear calculation printed on the outer circumference of said cylinder; and said transparent window having a sliding member including a transparent viewing area through which a resultant calculation value is viewed upon a selection of desired settings for the first and second numerical value scales.

2. The writing instrument of claim 1, wherein the first numerical scale is printed on the rotatable cylinder.

3. The writing instrument of claim 1, wherein the first numerical scale is located on the outer circumference of the writing instrument.

4. The writing instrument of claim 1, wherein a clip is attached to the second end, said clip having a surface on which advertising or graphical material may be printed.

5. The writing instrument of claim 1, wherein a cushioned grip is attached to the first end, said rubber grip having a surface on which advertising or graphical material may be printed.

6. The writing instrument of claim 1, wherein a stylus tip is attached to the first end.

7. The writing instrument of claim 1 wherein advertising or graphical material is imprinted on at least one outer surface of the writing instrument for the purpose of advertising or promotion.

8. A method to determine the resultant value of a non-linear equation by means of using a writing instrument comprising of:

an elongated housing having a first end and a second end;

said first end including a means for writing comprising of an ink or other writing tip, with said writing tip extending through an axial orifice in the first end;

said second end having an outer surface rotatably engaged to a rotatable dial having a first numerical values scale with designations printed so as to be visible at the circumference of the writing instrument;

said second end further including a second numerical values scale printed longitudinally along its outer surface and an elongated transparent window that extends longitudinally along said outer surface in parallel to said second scale;

said dial rigidly affixed to a rotatable cylinder disposed radially inward of the housing within said second end and having resultant calculation values of a desired non-linear calculation printed on the outer circumference of said cylinder; and said transparent window having a sliding member including a transparent viewing area through which a resultant calculation value is viewed upon a selection of desired settings for the first and second numerical value scales.

9. A method of advertising or promotion whereby printed or graphical material is imprinted on at least one outer surface of a writing instrument having:

an elongated housing having a first end and a second end;

said first end including a means for writing comprising of an ink or other writing tip, with said writing tip extending through an axial orifice in the first end;

said second end having an outer surface rotatably engaged to a rotatable dial having a first numerical values scale with designations printed so as to be visible at the circumference of the writing instrument;

said second end further including a second numerical values scale printed longitudinally along its outer surface and an elongated transparent window that extends longitudinally along said outer surface in parallel to said second scale;

said dial rigidly affixed to a rotatable cylinder disposed radially inward of the housing within said second end and having resultant calculation values of a desired non-linear calculation printed on the outer circumference of said cylinder; and said transparent window having a sliding member including a transparent viewing area through which a resultant calculation value is viewed upon a selection of desired settings for the first and second numerical value scales.

* * * * *